US007477853B2

(12) United States Patent
Odani

(10) Patent No.: US 7,477,853 B2
(45) Date of Patent: Jan. 13, 2009

(54) TONER CARTRIDGE HAVING MACHINE READABLE AUTHENTICATION PATTERN AND IMAGE FORMING APPARATUS FOR READING THE SAME

(75) Inventor: Makoto Odani, Shizuoka-ken (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 160 days.

(21) Appl. No.: 11/460,222

(22) Filed: Jul. 26, 2006

(65) Prior Publication Data

US 2008/0025735 A1 Jan. 31, 2008

(51) Int. Cl.
*G03G 15/00* (2006.01)

(52) U.S. Cl. ..... 399/12; 399/110; 399/111; 399/120; 341/3; 341/50

(58) Field of Classification Search ..... 399/12, 399/111, 262; 235/494, 432, 435, 447, 487
See application file for complete search history.

(56) References Cited

U.S. PATENT DOCUMENTS 2,952,008 A * 9/1960 Mitchell et al. ..... 360/47
3,692,988 A * 9/1972 Dlugos et al. ..... 705/407
4,172,554 A * 10/1979 Clarinval et al. ..... 235/454
4,259,569 A * 3/1981 Passer et al. ..... 235/462.04
5,229,585 A * 7/1993 Lemberger et al. ..... 235/375
5,317,139 A * 5/1994 Evans et al. ..... 235/462.05
5,357,094 A * 10/1994 Baldwin ..... 235/462.02
5,596,388 A * 1/1997 Ohkubo et al. ..... 399/111
6,546,211 B1 * 4/2003 Shishikura ..... 399/12
7,016,072 B1 * 3/2006 Yamazaki ..... 358/1.9

FOREIGN PATENT DOCUMENTS

JP 05-224479 2/1992
JP 11-194599 7/1999

* cited by examiner

*Primary Examiner*—David M Gray
*Assistant Examiner*—G. M. Hyder
(74) *Attorney, Agent, or Firm*—SoCal IP Law Group LLP; Steven C. Sereboff; John E. Gunther

(57) ABSTRACT

A toner cartridge is attachable/detachable to/from a main body of an image forming apparatus. A code pattern is provided on an outer peripheral surface of the toner container and can be read by a photosensor or a mechanical switch. The code pattern includes a first pattern string which is provided on the outer peripheral surface of the toner container along an insertion direction and in which a first and a second patterns respectively indicating different binary levels are alternately arranged at a specified period, and a second pattern string which is provided to be shifted from the first pattern string in the insertion direction by almost a half period and in which the plural first patterns and the plural second patterns are combined and are arranged.

4 Claims, 10 Drawing Sheets

TONER CARTRIDGE HAVING MACHINE READABLE AUTHENTICATION PATTERN AND IMAGE FORMING APPARATUS FOR READING THE SAME

BACKGROUND OF THE INVENTION

1. Field of the Invention

The present invention relates to an image forming apparatus, such as an MFP (Multi-Function Peripherals) as a digital compound machine, a copier or a printer, and a toner cartridge used for the image forming apparatus.

2. Description of the Related Art

Heretofore, an image forming apparatus such as an MFP includes a toner cartridge for supplying toner to a developing device. The toner cartridge is attachable/detachable to/from the image forming apparatus, and when the toner in the toner cartridge runs out, the user can replace the toner cartridge.

In a conventional image forming apparatus, in order to prevent a toner cartridge not meeting the specifications from being mounted, there is an example in which a storage medium, such as a nonvolatile memory or an IC tag, is attached to a main body of the toner cartridge, and data such as a model number is stored in this storage medium. In the image forming apparatus, the data of the model number stored in the storage medium is read to judge whether the toner cartridge meets the specifications, and it is prevented for an incorrect toner cartridge from being mounted.

Besides, in addition to the data of the model number of the toner cartridge, data such as the date of manufacture and a toner capacity are also stored in the storage medium, and the image forming apparatus reads the data of the toner capacity to calculate data of toner empty, or reads the data of the date of manufacture to limit the use of the expired toner. Besides, in addition to the method of storing various data in the storage medium, there is also a method in which a bar code label is affixed to a main body of a toner cartridge, and the bar code is read by a reader to obtain various information.

JP-A-5-224479 discloses an example in which a bar code is displayed on a toner cartridge and a bar code reader is provided in an image forming apparatus. In this example, the bar code displayed on the toner cartridge is read by the bar code reader, so that it is judged whether or not the proper toner cartridge is mounted.

However, in the example in which the bar code reader is used, the bar code reader is expensive. Then, although it is also possible to read the bar code displayed on the toner cartridge by an inexpensive photosensor or the like, there is a defect that in the case where the toner cartridge is manually mounted, since the insertion speed at the time of mounting is changed, the bar code can not be accurately read by the photosensor.

Besides, JP-A-11-194599 discloses an example in which a display body capable of displaying a temperature history is affixed to a toner cartridge. In this example, when the toner cartridge is placed in a high temperature atmosphere for a long time and the toner is deteriorated, the deterioration can be detected. The display body changes its color when it is left in the high temperature for a long time, and the change of the color of the display body is read by a sensor provided in an image forming apparatus.

In the example using the display body to display the temperature history, it is necessary to use the special display body whose color is changed by the temperature change. Besides, there is a defect that other various information can not be stored in the display body.

The invention provides a toner cartridge in which information intrinsic to the toner cartridge can be easily read by a photosensor or a mechanical switch, and an image forming apparatus.

DETAILED DESCRIPTION OF THE INVENTION

Throughout this description, the embodiments and examples shown should be considered as exemplars, rather than limitations on the apparatus of the present invention.

Figure 1:
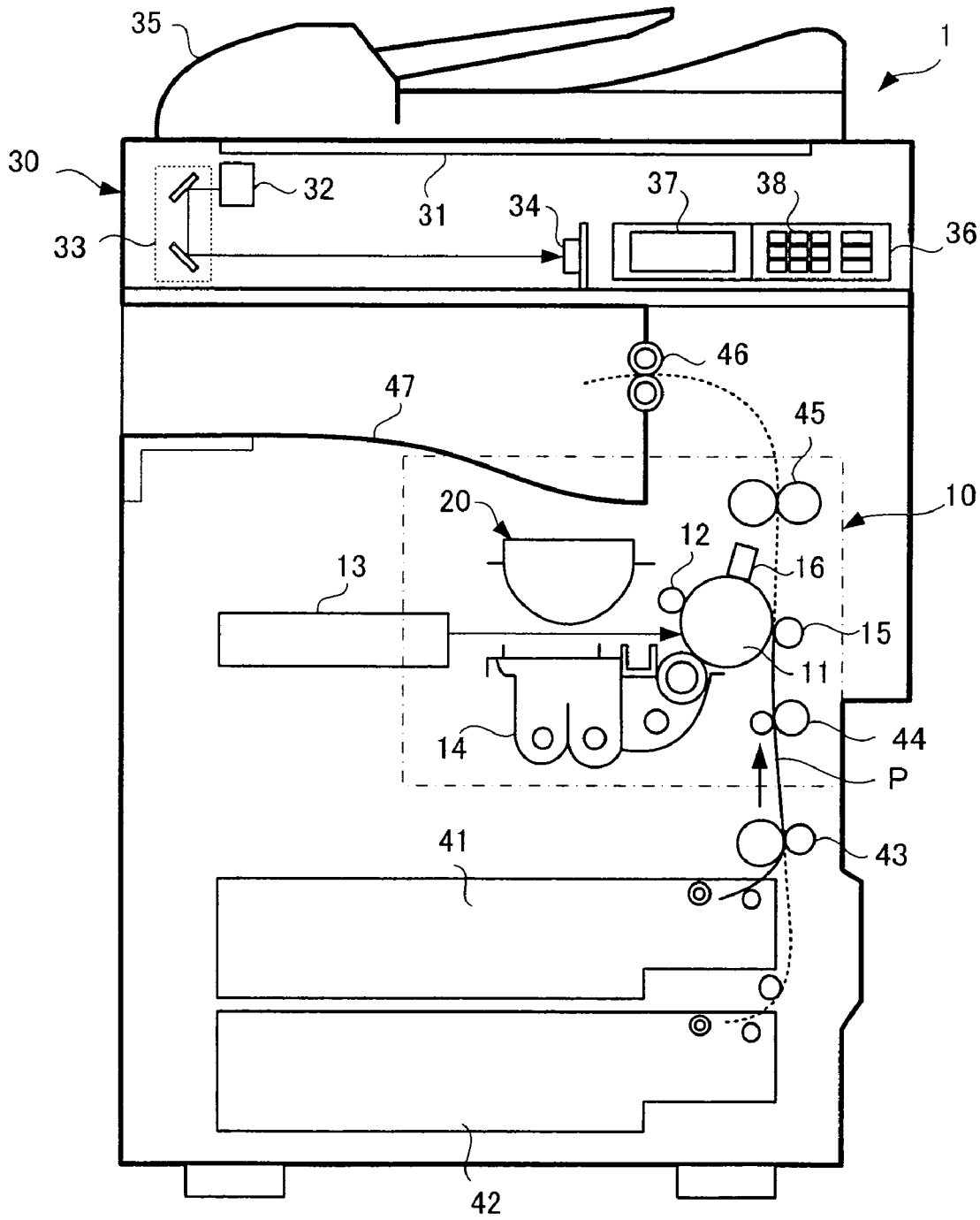
FIG. 1 is a structural view schematically showing the whole structure of an image forming apparatus of an embodiment of the invention.

Hereinafter, embodiments of the invention will be described in detail with reference to the drawings. FIG. 1 is a structural view schematically showing the whole structure of an image forming apparatus of an embodiment of the invention. Incidentally, in FIG. 1, although a description will be made while using an MFP (Multi-Function Peripherals) as an example of the image forming apparatus, the invention can be applied also to a copier, a printer or the like.

In FIG. 1, 1 denotes an image forming apparatus, and a printer unit 10 is provided at the center part of the apparatus. The printer unit 10 includes a rotatable photoconductive drum 11, and around the photoconductive drum 11, there are provided a charger 12 to charge the surface of the photoconductive drum 11, a laser unit 13 to form an electrostatic latent image on the surface of the photoconductive drum 11, a developing unit 14 to develop the electrostatic latent image of the photoconductive drum 11 with toner, a transfer roller 15 to transfer the toner image on the photoconductive drum 11 to a sheet, and a cleaner 16 to remove residual toner on the photoconductive drum 11.

The developing unit 14 contains a developer including a carrier and a toner, and a toner cartridge 20 to supply toner to the developing unit 14 is attachably/detachably disposed above that. The toner cartridge 20 can be replaced by the user, and can be put in and out by opening a cover (not shown) provided in the image forming apparatus 1. Although a switch to detect the opening/closing of the cover and a switch to detect the attachment/detachment of the toner cartridge are provided, they will be described later.

A scanner 30 is provided at an upper part of the image forming apparatus 1. The scanner 30 is for reading a document placed on a document mounting table 31, and includes a light source 32 to irradiate a light to the document placed on the document mounting table 31, a reflecting mirror 33 to reflect the light reflected from the document, and a light receiving element 34 to receive the light reflected from the reflecting mirror 33.

Besides, an automatic document feeder (ADF) 35 and an operation panel 36 are provided at an upper part of the document mounting table 31. The operation panel 36 includes a display unit 37 and an operation unit 38.

Further, paper feed cassettes 41 and 42 of plural stages are provided at a lower part of the image forming apparatus 1, and a sheet P in these paper feed cassettes 41 and 42 is transported upward by a transport roller 43, a register roller 44 and a fixing roller 45, and is discharged onto a paper discharge tray 47 by a paper discharge roller 46.

At the time of image formation, the light is irradiated to the document on the document mounting table 31 from the light source 32, the light reflected from the document is incident on the light receiving element 34 through the reflecting mirror 33, and the document image is read. Based on the information read by the light receiving element 34, a laser beam is outputted from the laser unit 13, and the surface of the photoconductive drum 11 is irradiated with this laser beam. The surface of the photoconductive drum 11 is negatively charged by the charger 12, and the photoconductive drum 11 is exposed by the irradiation with the laser beam from the laser unit 13.

By this, an electrostatic latent image is formed on the surface of the photoconductive drum 11. The electrostatic latent image formed on the photoconductive drum 11 adsorbs toner by the developing unit 14 and becomes a visualized image (toner image). When the sheet P taken out from the paper feed cassette 41 or 42 is transported, the visualized image on the photoconductive drum 11 is transferred to the sheet P by the transfer roller 15. The sheet P on which the image has been transferred is transported to the fixing roller 45, and is heated and pressed so that the image is fixed to the sheet P. The sheet P on which the image has been fixed is discharged onto the paper discharge tray 47 through the paper discharge roller pair 46.

On the other hand, the toner remaining on the surface of the photoconductive drum 11 is removed by the cleaner 16, and then is collected. Besides, when the toner in the developing unit 14 is consumed by the development, toner is supplied from the toner cartridge 20.

Figure 2:
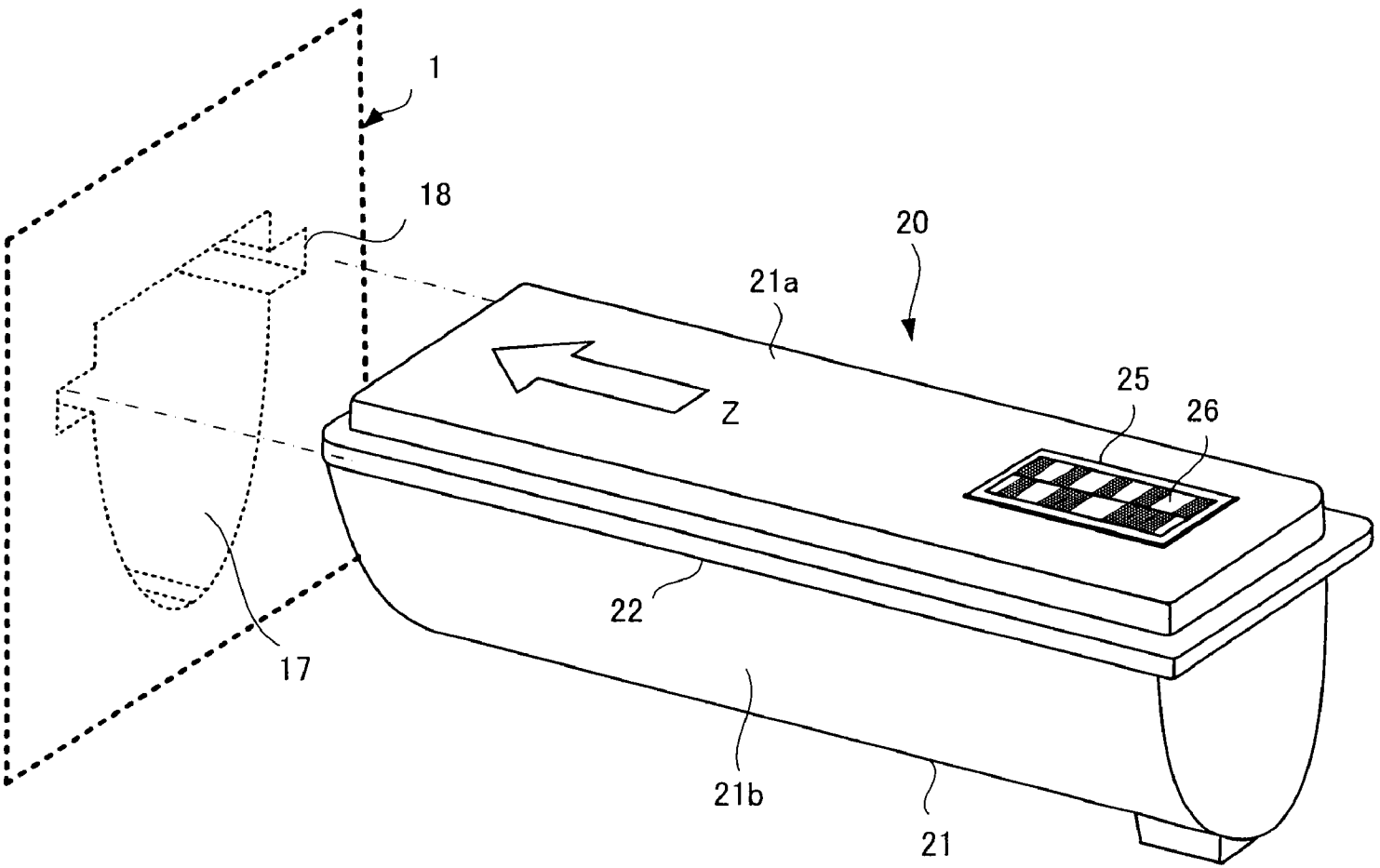
FIG. 2 is a perspective view showing an embodiment of a toner cartridge used for the image forming apparatus of the invention.
Figure 3A:
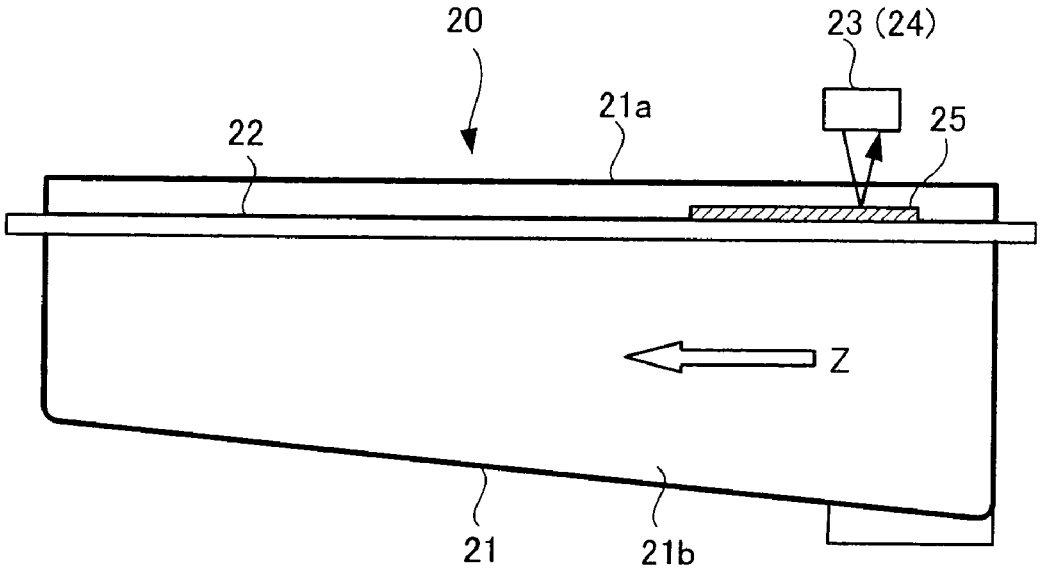
FIG. 3A is a side view showing the embodiment of the toner cartridge of the invention.
Figure 3B:
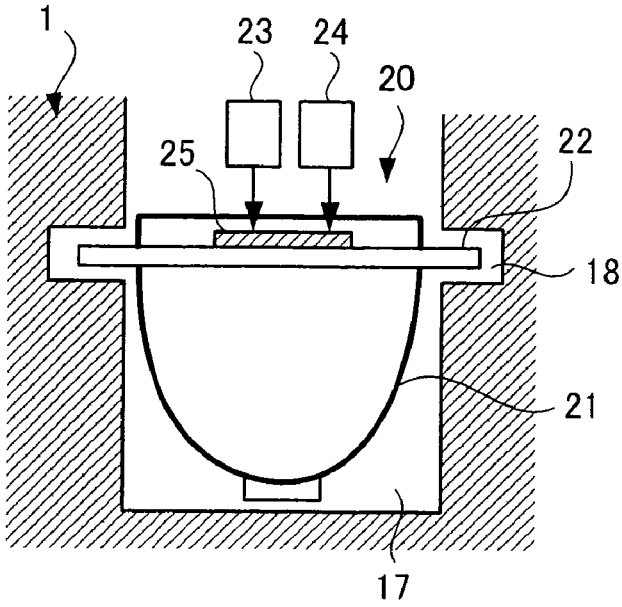
FIG. 3B is a front view showing a state in which the toner cartridge of the invention is mounted in the image forming apparatus.

Next, the structure of the toner cartridge 20 will be described with reference to FIG. 2, FIG. 3A and FIG. 3B. FIG. 2 is a perspective view showing the toner cartridge 20, FIG. 3A is a side view of the toner cartridge 20, and FIG. 3B is a front view of the toner cartridge 20. Incidentally, in FIG. 2, a housing unit 17 for the toner cartridge 20 in the image forming apparatus 1 is schematically indicated by a dotted line.

The toner cartridge 20 includes a long toner container 21 containing the toner. The toner container 21 includes an upper case 21*a* and a lower case 21*b* which can be vertically separated, and a rod-like screw (not shown) for transporting the toner to a discharge port (not shown) is provided at an inner bottom of the lower case 21*b* in a longitudinal direction.

Besides, a guide member 22 is provided on the outer peripheral surface of the toner container 21 along the longitudinal direction. A groove 18 is formed in the housing unit 17, and when the toner cartridge 20 is mounted in the housing unit 17 of the image forming apparatus 1, the guide member 22 is put in the groove 18 and is inserted so that the mounting can be smoothly performed. Incidentally, the insertion direction at the time when the toner cartridge 20 is mounted in the housing unit 17 is indicated by an arrow Z.

Besides, a seal 25 is affixed to the upper surface of the toner cartridge 20 so as to be parallel to the insertion direction Z. A code pattern 26 to indicate various information such as the model number of the toner cartridge 20, the date of manufacture, and a toner capacity is printed on the seal 25. The code pattern 26 is printed along the insertion direction (Z) of the toner cartridge 20.

On the other hand, photosensors 23 and 24 to read the code pattern 26 are attached in the vicinity of the inlet of the housing unit 17 in the image forming apparatus 1 as shown in FIGS. 3A and 3B. By this, when the toner cartridge 20 is inserted in the housing unit 17, the code pattern 26 moving in the Z direction can be successively read by the photosensors 23 and 24. Incidentally, the positions where the photosensors 23 and 24 are attached are determined by the affixed position of the seal 25. A specific pattern arrangement of the code pattern 26 will be described later.

When the toner cartridge 20 is inserted, since a guide mechanism including the guide member 22 and the groove 18 is provided, a constant distance can be kept between the photosensor 23, 24 and the print surface of the seal 25.

Each of the photosensors 23 and 24 includes a light emitting element such as an LED and a light receiving element to detect the light outputted from this light emitting element. Besides, although a specific example of the code pattern 26 printed on the seal 25 will be described later, it includes a pattern of two colors different in lightness (for example, a white and black pattern). The light from the light emitting element of the photosensor 23, 24 is irradiated to the code pattern 26, and the reflected light is detected by the light receiving element. Since the reflection of the light at the white portion of the code pattern 26 is intense, and the reflection of the light at the black portion is weak, data indicated by the binary level of 1 and 0 can be acquired by slicing the received light level detected by the light receiving element by a specified threshold.

When the toner cartridge 20 is replaced, since the cover (not shown) provided in the image forming apparatus 1 is opened, the electric power of a transport system and the like of the sheet P is stopped for safety, however, the photosensors 23 and 24 are made to normally operate.

Next, a control system of the image forming apparatus of the invention will be described with reference to FIG. 4.

Figure 4:
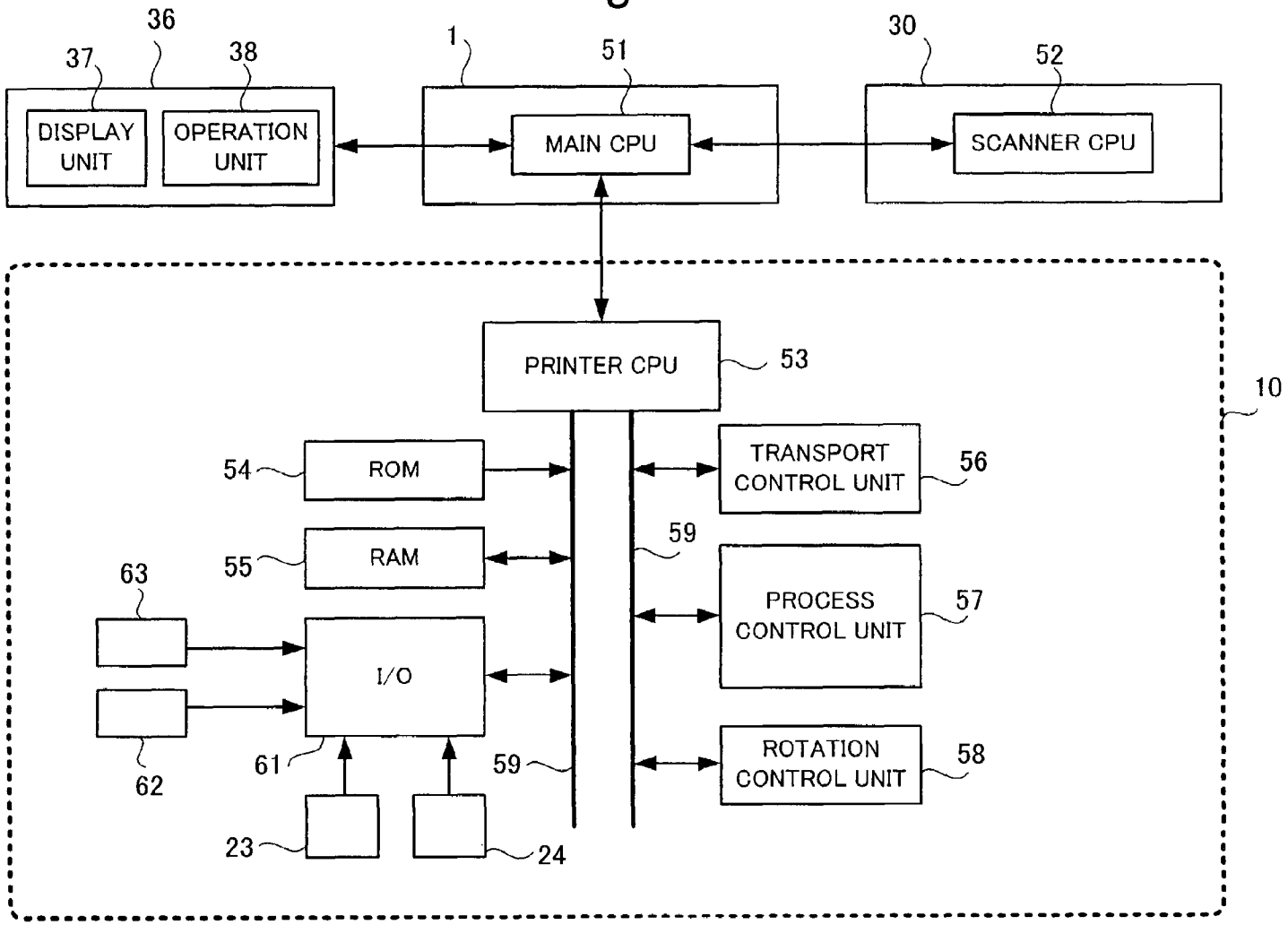
FIG. 4 is a block diagram showing a structure of a control system of the image forming apparatus of the invention.

The control system of FIG. 4 includes a main CPU 51 to control the whole operation of the image forming apparatus 1, a scanner unit 30, a printer unit 10 and an operation panel 36. The scanner unit 30 includes a scanner CPU 52, the printer unit 10 includes a printer CPU 53, and the operation panel 36 includes the display unit 37 and the operation unit 38. The main CPU 5 is connected to the scanner CPU 52, the printer CPU 53, and the operation panel 36.

A ROM 54 in which a control program and the like are stored, a RAM 55 for data storage, and a transport control unit 56 to control the transporting of the sheet are connected to the printer CPU 53 through a bus 59. Further, a process control unit 57 to control the image creation process of charging, development and transfer is connected to the printer CPU 53 through the bus 59.

Besides, an I/O (Input/Output IC) 61 including, for example, an ASIC is connected to the printer CPU 53. The I/O 61 is connected with a switch 62 to detect the mounting of the toner cartridge 20 and a switch 63 to detect the opening of the cover (not shown) of the image forming apparatus 1, and is further connected with the photosensors 23 and 24.

The I/O 61 detects the opening/closing state of the cover and the mounting state of the toner cartridge 20 by the on/off states of the detection switches 62 and 63, and transmits them to the printer CPU 53. Besides, data of the code pattern read by the photosensors 23 and 24 is transmitted to the printer CPU 53.

Figure 5:
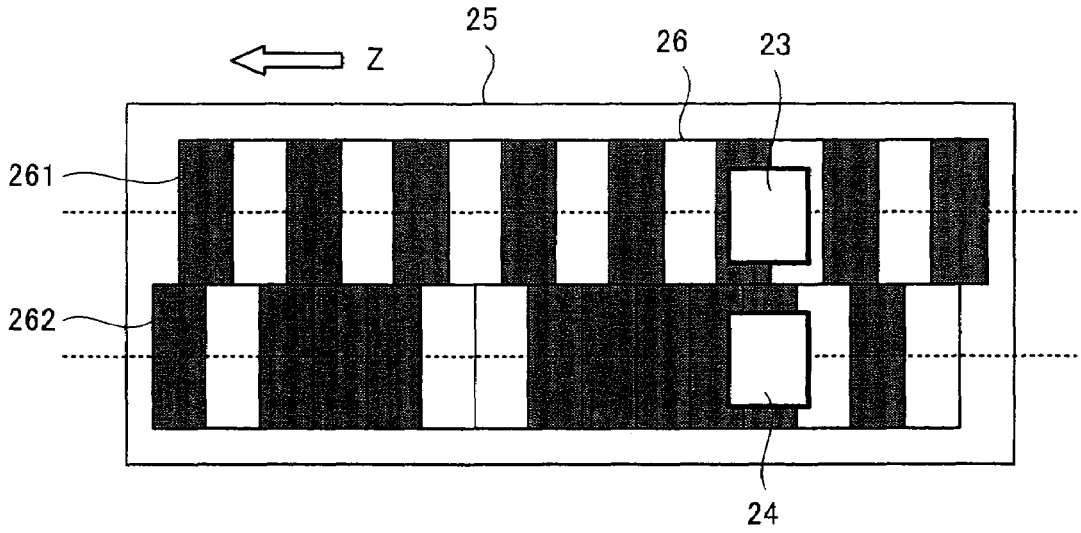
FIG. 5 is a plan view showing an embodiment of a code pattern used in the toner cartridge of the invention.

Next, the code pattern 26 printed on the seal 25 will be described with reference to FIG. 5. In FIG. 5, the code pattern 26 includes a first pattern string 261 to indicate a reference signal, and a second pattern string 262 to indicate data such as the model number of the toner cartridge 20 and the date of manufacture.

In the first pattern string 261, the white and black patterns are alternately regularly arranged along the insertion direction Z. The white and black patterns are a first and a second patterns to indicate the binary levels different from each other, and since they are different from each other in lightness, they can be optically read.

The second pattern string 262 is provided to be shifted from the first pattern string 261 by a half period and is provided to be in parallel thereto. Although the second pattern string 262 includes white and black patterns, a change point from white to black and a change point from black to white are positioned at center parts of the respective patterns of the first pattern string 251. The first pattern string 261 is read by the photosensor 23, and the second pattern string 262 is read by the photosensor 24.

When the cover (not shown) is opened at the time of mounting of the toner cartridge 20, the opening of the cover is detected by the detection switch 63, and the photosensors 23 and 24 become capable of reading the code pattern 26. When the toner cartridge 20 is inserted in the housing unit 17, the seal 25 affixed to the toner cartridge 20 passes in front of the photosensors 23 and 24 in the insertion process. By this, the photosensors 23 and 24 respectively read the pattern strings 261 and 262, and signal outputs as shown in FIG. 6 can be obtained from the photosensors 23 and 24.

Figure 6:
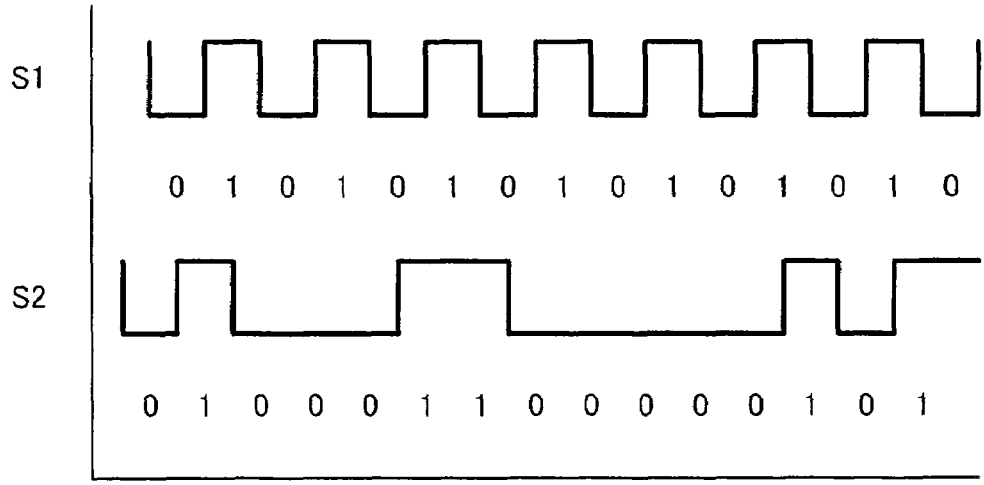
FIG. 6 is a waveform view for explaining a read operation of the code pattern of FIG. 5.

S1 of FIG. 6 denotes a reference signal obtained by reading the first pattern string 261, and since the white pattern is represented by "1" and the black pattern is represented by "0", the signals of 1 and 0 are alternately outputted. S2 of FIG. 6 denotes data output at the time when the second pattern string 262 is read, and data like "0100011 . . . " is outputted. The data output S2 indicates the model number of the toner cartridge 20, the date of manufacture, the toner capacity and the like.

The reference signal S1 and the data output S2 read by the photosensors 23 and 24 are sent to the printer CPU 53 through the I/O 61, and the printer CPU 53 reads the reference signal S1 and the data output S2, and judges the information such as the model number of the toner cartridge 20. The information is stored in the RAM 55.

When the toner cartridge 20 is inserted in the housing unit 17, the insertion speed varies according to each individual. Thus, there is a fear that the data output S2 is changed according to the difference in the insertion speed. Then, in the invention, the pattern string 261 of the reference signal and the pattern string 262 of the data are paired with each other and are arranged. Since the printer CPU 53 judges whether the data output S2 of the pattern string 262 is 1 or 0 in accordance with the occurrence timing of the reference signal S1, even if the insertion speed of the cartridge is not constant, the data output S2 can be accurately generated. Besides, as the RAM 55, it is appropriate to use a nonvolatile memory so that even if the electric power is turned off, the data does not disappear.

Figure 7:
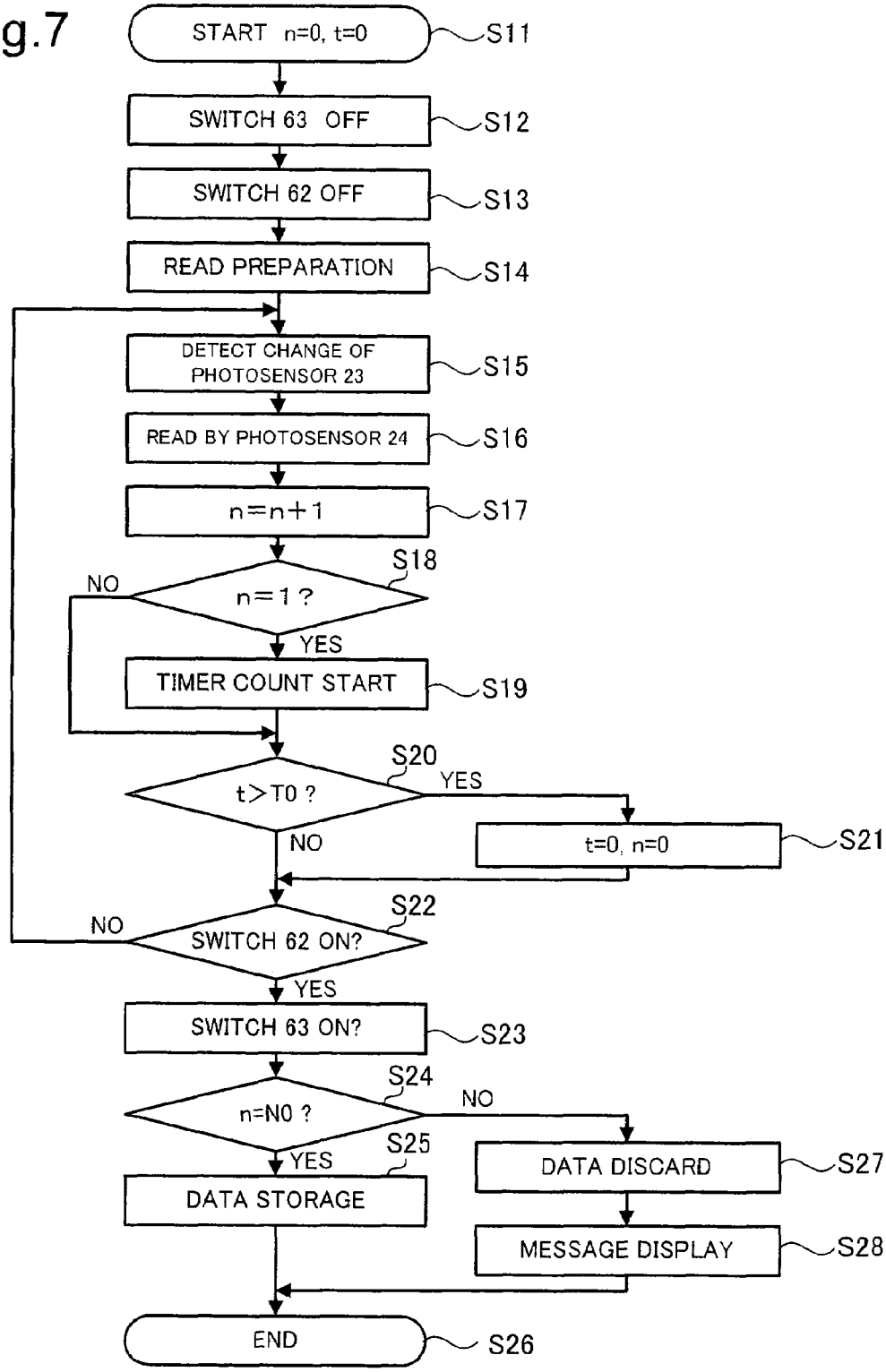
FIG. 7 is a flowchart for explaining an operation of the image forming apparatus of the invention.

FIG. 7 is a flowchart for explaining an operation at the time of replacement of the toner cartridge 20 in the image forming apparatus of the invention. The operation of FIG. 7 is performed under the control of the printer CPU 53 and the main CPU 51.

First, at start step S11, a count value n to indicate the number of times of change of the reference signal S1 is made (n=0), and a read time t of the data output S2 is set to (t=0). Step S12 indicates that the cover is opened for toner replacement and the cover detection switch 63 is turned off, and step S13 indicates that the toner cartridge 20 is pulled out or has not been inserted, and the detection switch 62 is turned off. At step S14, there occurs waiting for reading of the photosensors 23 and 24, and preparation is made for the reading of the reference signal S1 and the data output S2.

When the toner cartridge 20 is pulled out and a replacement product is inserted, at next step S15, the pattern string 261 is read by the photosensor 23, and it is detected that the reference signal S1 is changed from 0 to 1 or from 1 to 0. Then, at step S16, the reading of the pattern string 262 by the photosensor 24 starts at the timing when the reference signal S1 is changed.

At step S17, the count value n of the number of times of change of the reference signal S1 is counted up (n=n+1), and at step S18, it is judged whether n =1 is established. Here, when n=1 is established, at next step S19, the count of the time t is started by a timer, and at step S18, when n is not 1, advance is made to step S20. At step S20, it is judged whether or not the count value of the time t by the timer exceeds a previously set upper limit value T0.

When the time t is the upper limit value T0 or less, advance is made to step S22. Besides, at step S20, in the case where it exceeds the upper limit value T0 (t>T0), advance is made to step S21, t=0 and n=0 are made to be established, and advance is made to step S22. At step S22, it is judged whether or not the detection switch 62 detects the mounting of the toner cartridge 20. Until the cartridge 20 is mounted, return is made to step S15 from step S22, and the reading of the reference signal S1 is performed.

Incidentally, at step S17, the reason why n=n+1 is made to be established is that in order to judge whether the data output S2 is correctly read, the number of times of read is counted up. Besides, steps S18, S19 and S20 are steps of confirming whether the time from the start of reading of the data output S2 to the completion of the insertion of the toner cartridge 20 is a specific time or less. In the case the toner cartridge 20 is stopped in the middle of the insertion, or is halfway pulled out, a shift is made to step S21, and the count values are made t=0 and n=0 and are returned to the original.

Until the cartridge 20 is mounted, the reference signal S1 and the data output S2 are read, the reading of the data output S2 is performed at the timing when the reference signal S1 is changed, and the analysis of the data output S2 is performed.

At step S22, when the mounting of the toner cartridge 20 is detected, at step S23, it is judged by the state of the detection switch 63 whether or not the cover is closed. At next step S24, it is judged whether or not the number of times of change of the reference signal S1 is a previously prescribed number of times (N0), and when it is the prescribed number of times N0 (n=N0), at step S25, it is assumed that the read data output S2 is correct, and it is stored in the RAM 55, and the operation is ended at step S26.

At step S24, in the case where the number of times of change of the reference signal S1 is different from the prescribed number of times (N0), a shift is made to step S27, and the data is not kept but is discarded. At step S28, a message to urge the reinsertion of the toner cartridge 20, for example, "Please insert toner cartridge again" is displayed on the display unit 37 of the operation panel 36, and advance is made to the end step S26.

When the toner cartridge 20 is mounted as prescribed in this way, the data at that time is stored, and in the case where it is not mounted as prescribed, the message is displayed and the user can be notified.

In the case where the read data output S2 indicates the model number, the printer CPU 53 judges whether the toner cartridge 20 of the model number meets the specifications of the image forming apparatus 1, and in the case where the improper toner cartridge is mounted, the message to request another replacement may be displayed on the display unit 37. Alternatively, also in the case where a pattern string to indicate the model number is not printed on the toner cartridge 20, it is similarly judged that the toner cartridge not meeting the specifications is mounted. According to circumstances, the printer CPU 53 controls the process control unit 57 and can also limit the print operation.

Besides, in the case where the read data output S2 is the data of the date of manufacture of the toner cartridge 20, on the basis of the data, the printer CPU 53 can judge whether or not the use period of the toner expires. In the case where the use period of the toner expires, the message to request another replacement may be displayed.

Further, in the case where the read data output S2 is data to indicate the toner capacity, the printer CPU 53 calculates the amount of toner consumed in the image forming apparatus 1 based on the data and the number of sheets at the time when printing is actually performed, compares it with the toner capacity read from the toner cartridge 20 to grasp the residual amount of toner, and can display toner empty.

In this way, the code pattern 26 printed on the seal 25 of the toner cartridge 20 is read, and can be used for the control of the display and the control of the process control unit 57.

[Modified Example 1 of the Code Pattern 26]

Figure 8:
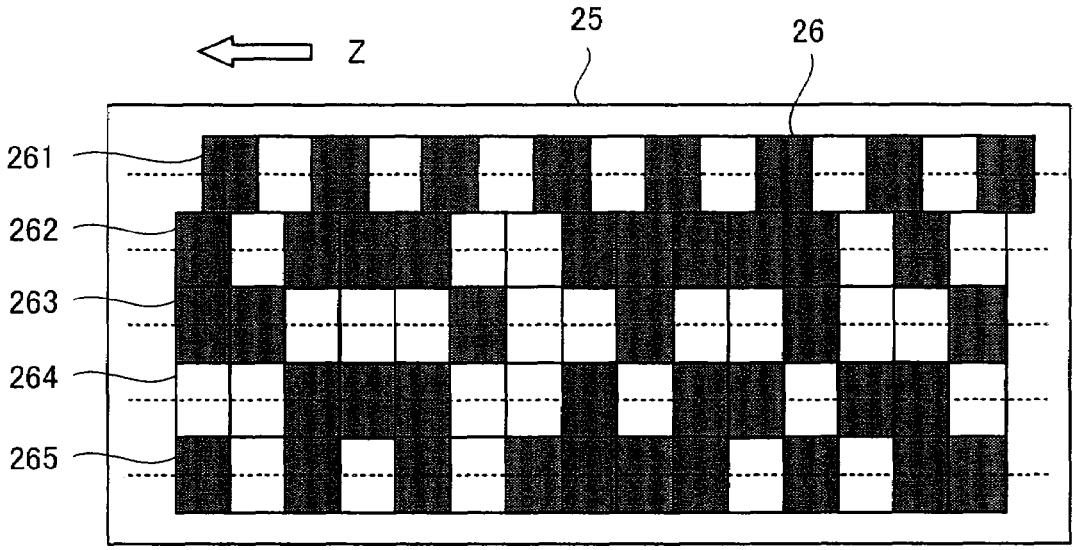
FIG. 8 is a plan view showing a first modified example of the code pattern used for the invention.

FIG. 8 shows a first modified example of the code pattern 26 printed on the seal 25. FIG. 8 shows the example including a first pattern string 261 to indicate a reference signal and plural pattern strings 262 to 265 for data. By using the plural pattern strings for data as stated above, a bit string of data can be increased. In the case where the code pattern 26 can not be printed lengthwise because of space, the bit length can be lengthened by using the plural strings.

Alternatively, the pattern strings 262 to 265 may respectively indicate different information. For example, the pattern string 262 may indicate the model number of the toner cartridge 20, the pattern string 263 may indicate the date of manufacture, and the pattern string 264 may indicate the toner capacity. In the case of FIG. 8, in order to read all pattern strings, it is necessary to increase the number of photosensors similarly.

[Modified Example 2 of the Code Pattern 26]

Figure 9:
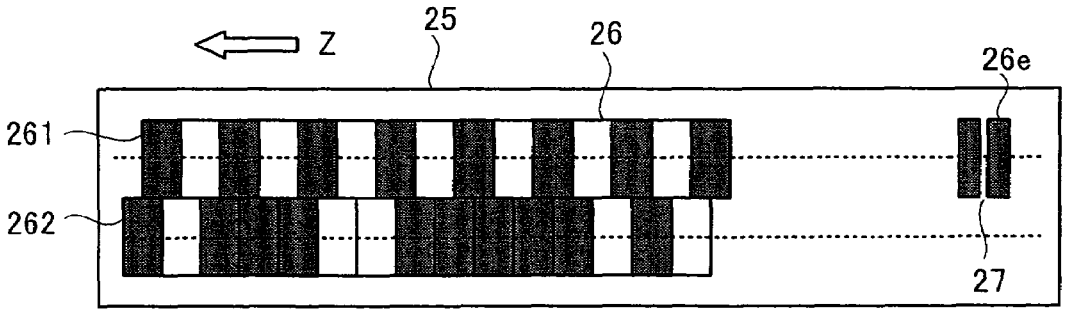
FIG. 9 is a plan view showing a second modified example of the code pattern used for the invention.

FIG. 9 shows a second modified example of the code pattern 26 printed on the seal 25. FIG. 9 includes a first pattern string 261 to indicate a reference signal and a pattern string 261 for data, and a slit 27 is formed in an end pattern 26*e* of the first pattern string 261.

In this case, when the toner cartridge 20 is inserted to the innermost portion of the housing unit 17, the end pattern 26*a* of the termination part is detected by the photosensor 23, and further, the existence of the slit 27 can be detected. The photosensor 23 detects the slit 27 so that the mounting of the toner cartridge 20 is detected, and accordingly, it can be used instead of the detection switch 62. Incidentally, the end pattern 26*a* and the slit 27 may be provided at the side of the second pattern string 262, and the slit 27 may be detected by the photosensor 24.

[Modified Example 3 of the Code Pattern 26]

Figure 10A:
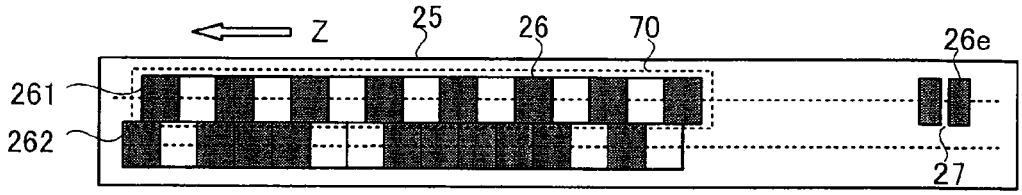
FIG. 10A is a plan view showing a third modified example of the code pattern used for the invention.

FIG. 10A shows a third modified example of the code pattern 26 printed on the seal 25. Although FIG. 10A is the same as FIG. 9 in that the pattern strings 261 and 262 and the slit 27 are included, a paint 70 made of temperature color changing material is applied to a part of or all of the pattern strings 261 and 262. The paint 70 has such a property that its color is changed when it is placed in an environment of a specified temperature or higher for a long time, and when the color is once changed, it is not returned to the original color.

Figure 10B:
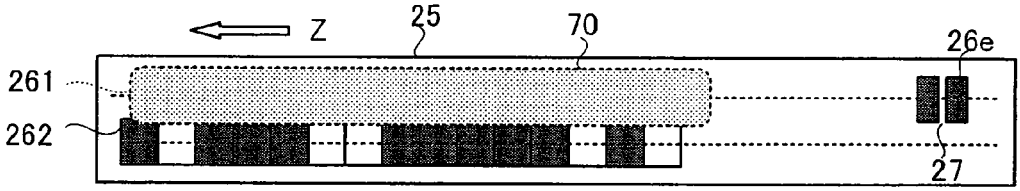
FIG. 10B is a plan view for explaining an operation of FIG. 10A.

In the case of FIG. 10A, when the temperature rises and the paint 70 changes its color, since the photosensors 23 and 24 can not read the pattern string 261, the printer CPU 53 performs an error processing at the time point when the pattern string 261 (reference signal S1) can not be read, and displays a message to urge the user to replace the toner cartridge 20. In general, when the toner is left as it is in a state of a specified temperature or higher, its color is changed, and proper color reproduction can not be performed, and therefore, there is an effect to suppress the use of the discolored toner. FIG. 10B shows a state after the paint 70 changes its color.

Figure 10C:
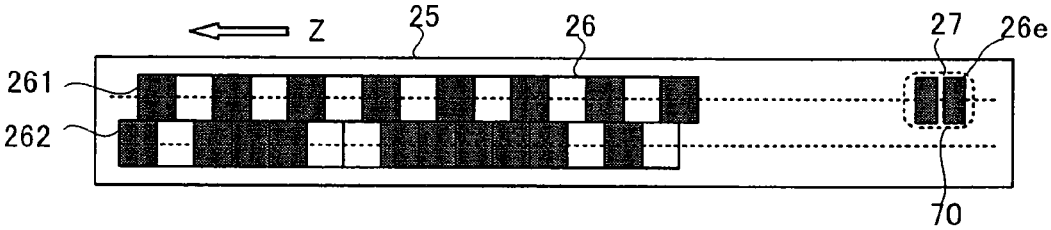
FIG. 10C is a plan view showing a modified example of the code pattern of FIG. 10A.

FIG. 10C shows another example in which a paint 70 is applied to an end pattern 26*e* of a pattern string 261. In this case, although the end pattern 26*e* and a slit 27 can be generally read, in the case where the paint 70 changes its color, the end pattern 26*e* can not be read, and therefore, the printer CPU 53 can perform an error processing.

[Modified Example 4 of the Code Pattern 26]

Figure 11:
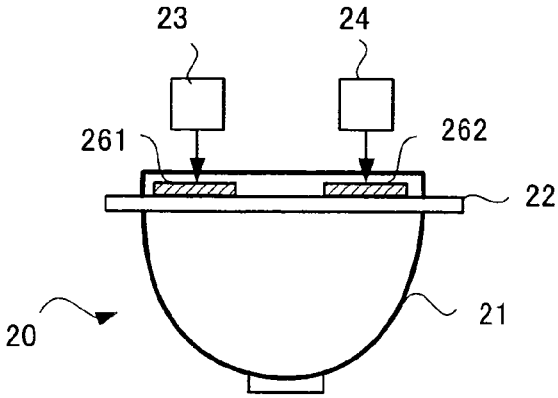
FIG. 11 is a front view for explaining a fourth modified example of the code pattern used for the invention and a read operation thereof.

FIG. 11 shows a fourth modified example of the code pattern 26 printed on the seal 25. In the example of FIG. 11, a pattern string 261 to obtain a reference signal. S1 and a pattern string 262 to obtain a data output S2 are provided at separate positions. That is, since the outputs of the photosensors 23 and 24 have only to be obtained at a synchronized timing, for example, the pattern string 261 of the reference signal S1 is provided at the left side along the insertion direction of the toner cartridge 20, and the pattern string 262 is provided at the right side, and in accordance with that, the photosensor 23 is provided at the left side, and the photosensor 24 is provided at the right side.

Figure 12A:
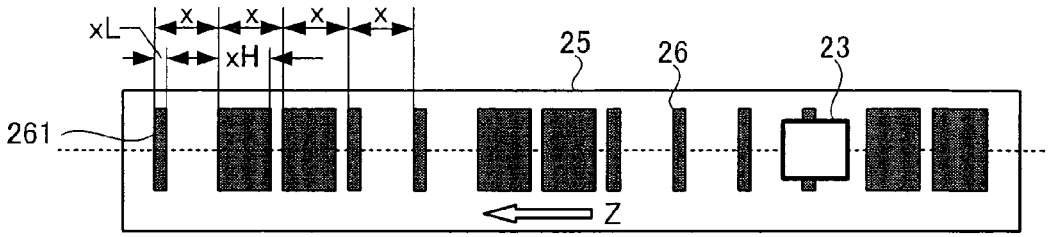
FIG. 12A is a plan view showing another embodiment of a code pattern used for the invention.

FIG. 12A shows another example of the code pattern 26 printed on the seal 25. The example of FIG. 12A shows a pattern string 26 in the case where the toner cartridge 20 can be inserted into the housing unit 17 at an almost constant speed. In this case, both signals of the reference signal S1 and the data output S2 can be read only by the photosensor 23.

That is, the pattern string 261 of FIG. 12A includes plural white and black patterns arranged continuously at a period x, and a first pattern string in which the ratio of occupation of the white pattern in one period is large, and a second pattern string in which the ratio of occupation of the black pattern in one period is large are combined and arranged.

Figure 12B:
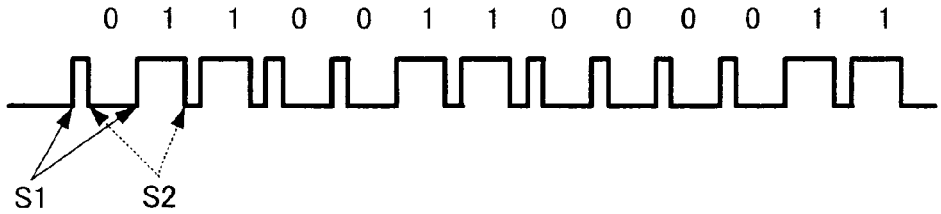
FIG. 12B is a waveform view for explaining a read operation of the code pattern of FIG. 12A.

When the pattern string 261 is read by the photosensor 23 and is processed, what is shown in FIG. 12B is obtained. In this example, the pattern in which the width of black in one period is narrow is indicated by "0", and the pattern in which the width of black in one period is wide is indicated by "1". That is, the reference signal S1 rises at the specific period x, and "1, 0" of the data output S2 can be judged according to whether the pattern width in one period is wide or narrow.

Here, in the case where the period is x, the width of the wide pattern is xH, the width of the narrow pattern is xL, and the insertion speed of the toner cartridge 20 is changed between V1-V2, when an average speed in an xH section is V1, and an average speed in a remaining section is V2, it is necessary to establish $$xH/x<V1/(V1+V2).$$

Besides, when the widths of xL and xH are set, it is necessary to set the widths so that even when the toner cartridge 20 passes at the envisaged maximum speed V1, it can be read by the photosensor 23.

Figure 13A:
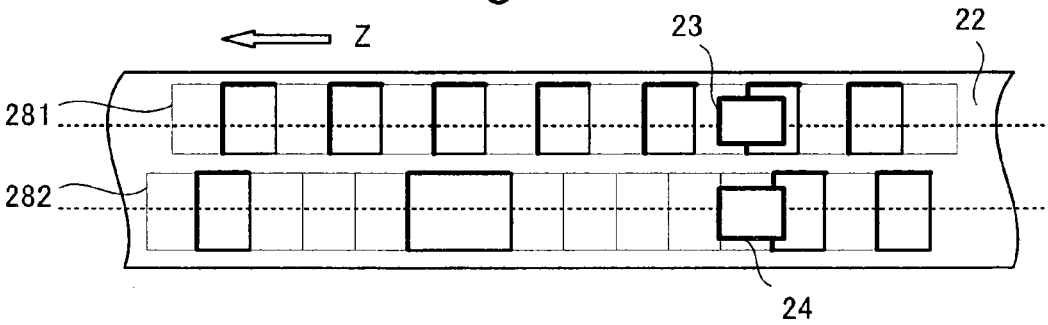
FIG. 13A is a plan view showing still another embodiment of a code pattern used for the invention.
Figure 13B:
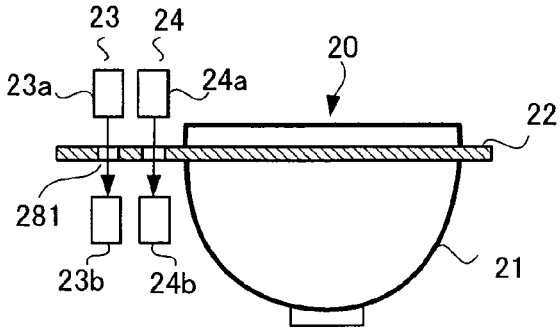
FIG. 13B is a front view for explaining a read operation of the code pattern of FIG. 13A.

FIG. 13A shows an example in which slit strings 281 and 282 are provided instead of the pattern strings 261 and 262 formed on the toner cartridge 20. In FIG. 13A, the width of the guide member 22 of the toner cartridge 20 is widened. The first slit string 281 to obtain the reference signal S1 and the second slit string 282 to obtain data such as the model number of the toner cartridge 20 and the date of manufacture are provided in this guide member 22.

The first slit string 281 is regularly provided along the insertion direction Z at regular intervals. The second slit string 282 is arranged to be shifted from the first slit string 281 by a half period, and the widths of the slits are different from each other. Above and below the guide member 22, photosensors 23 and 24 are provided at positions opposite to the first slit string 281 and the second slit string 282.

Light emitting elements 23*a* and 24*a* of the photosensors 23 and 24 are arranged, for example, above the guide member 22, and light receiving elements 23*b* and 24*b* of the photosensors 23 and 24 are arranged below the guide member 22. By this, light having passed through the slit strings 281 and 282 is read by the photosensors 23 and 24, and the reference signal S1 and the data output S2 indicated by "1" and "0" according to the existence of the slit can be obtained.

Figure 14A:
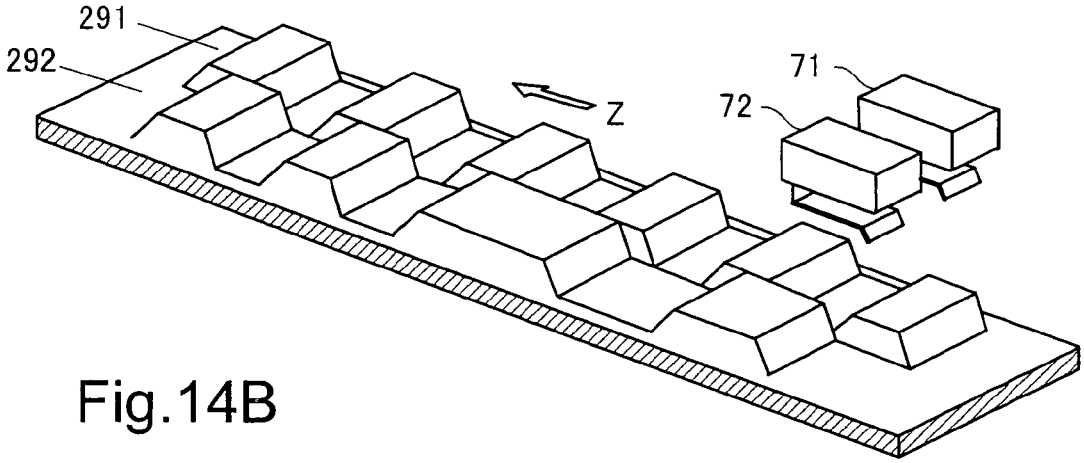
FIG. 14A is a perspective view showing another embodiment of a code pattern used for the invention.

FIG. 14A shows an example in which instead of the pattern strings 261 and 262 formed on the toner cartridge 20, concave-convex strings 291 and 292 are provided in the guide member 22. In the first concave-convex string 291, a concave portion and a convex portion are regularly arranged along the insertion direction at the same intervals. The second concave-convex string 292 is arranged to be shifted from the first concave-convex string 291 by a half period, and the widths of the concave portion and the convex portion are different from each other.

Figure 14B:
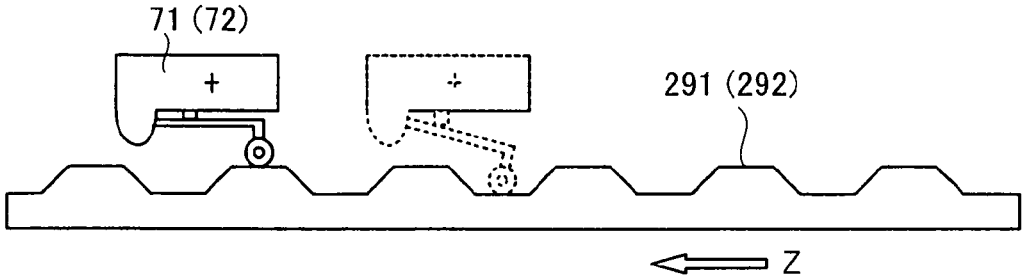
FIG. 14B is a side view for explaining a read operation of the code pattern of FIG. 14A.

Besides, as shown in FIG. 14B, mechanical switches 71 and 72 are provided above the guide member 22 at positions opposite to the first concave-convex string 291 and the second concave-convex string 292. The mechanical switches 71 and 72 mechanically read the concave-convex change when the concave-convex string 291 and the concave-convex string 292 are moved in the Z direction by the insertion of the toner cartridge 20. For example, the switch is turned on in the convex portion and becomes "1", and the switch is turned off in the concave portion and becomes "0".

As stated above, in the invention, the pattern string provided on the toner cartridge 20 is optically read, the transmitted light based on the presence/absence of the slit string is judged, or the mechanical change due to the concave-convex string is read, so that the binary code can be represented.

According to the invention, without requiring the bar code reader or the scanning mechanism, and without requiring the storage medium such as a memory element, various data added to the toner cartridge 20 can be read by using the inexpensive photosensor or mechanical switch.

Figure 15:
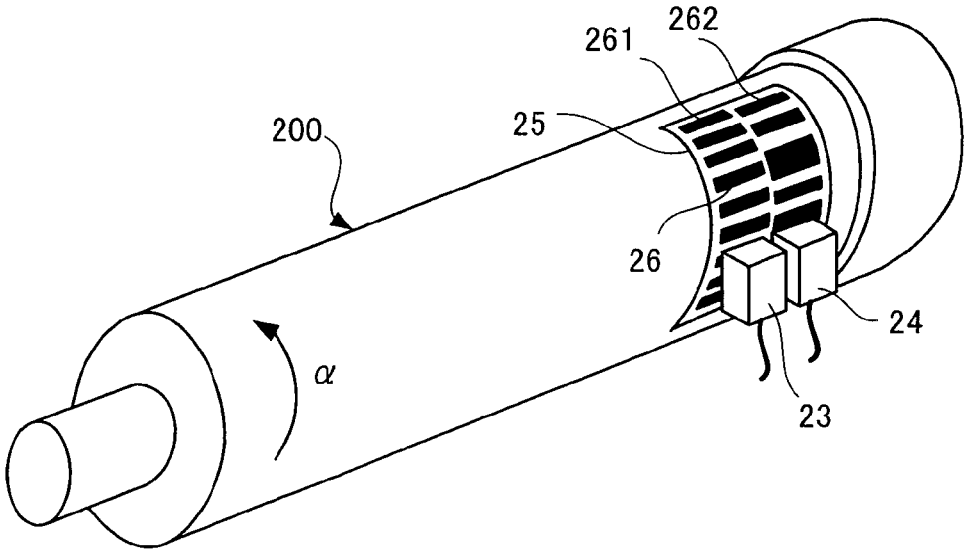
FIG. 15 is a perspective view showing another embodiment of a toner cartridge of the invention.

FIG. 15 is an explanatory view for explaining another embodiment of an image forming apparatus of the invention and a toner cartridge. FIG. 15 shows the image forming apparatus in the case where a rotary toner cartridge 200 (toner bottle) is used.

This embodiment includes the toner cartridge 200 with an almost cylindrical shape, and photosensors 23 and 24. The toner cartridge 200 can be attachably/detachably attached to the image forming apparatus 1, and at the time of mounting, it is driven by the rotation control unit 58 of FIG. 4, and is rotated in a direction of an arrow α. By this, toner is discharged through a toner supply hole (not shown) provided at the tip portion, and is supplied into the developing unit 14.

Besides, a seal 25 similar to that of FIG. 5 is affixed to the outer periphery of the toner cartridge 200 along the rotation direction α, and a code pattern 26 is printed. The code pattern 26 includes a pattern string 261 for a reference signal, and a pattern string 262 to indicate various information such as the model number of the toner cartridge 200, the date of manufacture, and the toner capacity.

On the other hand, the photosensors 23 and 24 are arranged at positions close to the toner cartridge 200 and opposite to the seal 25. By this, when the toner cartridge 200 is rotated, the pattern strings 261 and 262 moving in the a direction can be successively read by the photosensors 23 and 24.

In the case where the toner cartridge 200 is rotated by a motor, although it is difficult to perform the rotation at a constant speed because of a load of toner and the like, the code pattern 26 can be stably read. Incidentally, as the pattern strings 261 and 262, the examples of FIG. 8, FIG. 9, FIG. 10A, FIG. 10C, and FIG. 12A can also be applied. In this case, it is necessary to arrange the photosensors in accordance with the pattern strings.

As stated above, in the image forming apparatus of the invention, various information (code pattern) of the toner cartridge can be accurately read by the photosensors or the mechanical switches, and the low cost read means in which the error rate at the time of reading is low can be used.

Although exemplary embodiments of the present invention have been shown and described, it will be apparent to those having ordinary skill in the art that a number of changes, modifications, or alternations to the invention as described herein may be made, none of which depart from the spirit of the present invention. All such changes, modifications, and alterations should therefore be seen as within the scope of the present invention.

What is claimed is:

1. A toner cartridge attachable to a main body of an image forming apparatus or detachable from the main body, comprising:

a toner container that is inserted into a housing unit of the image forming apparatus from a first direction and can be mounted; and a code pattern that is provided on an outer peripheral surface of the toner container and can be optically read, wherein the code pattern includes a first pattern string which is provided along the first direction and in which a first and a second patterns respectively indicating different binary levels are alternately arranged at a specified period, and a second pattern string which is provided to be shifted from the first pattern string in the first direction by almost a half period and in which the plural first patterns and the plural second patterns are combined and are arranged, wherein the code pattern is printed on a seal affixed to an outer peripheral surface of the toner container to be capable of being read by a photosensor, in the first pattern string, a first pattern and a second pattern represented by two colors different in lightness are alternately arranged at the specified period, in the second pattern string, the plural first patterns and the plural second patterns represented by the two colors different in lightness are combined and are arranged, and the second pattern string is printed to be shifted from the first pattern string in the first direction by almost the half period, and in the code pattern, an end pattern is printed at a termination part of at least one of the first and the second pattern strings in the insertion direction and a slit is formed in the end pattern.

2. A toner cartridge attachable to a main body of an image forming apparatus or detachable from the main body, comprising:

a toner container that is inserted into a housing unit of the image forming apparatus from a first direction and can be mounted; and a code pattern that is provided on an outer peripheral surface of the toner container and can be optically read, wherein the code pattern includes a first pattern string which is provided along the first direction and in which a first and a second patterns respectively indicating different binary levels are alternately arranged at a specified period, and a second pattern string which is provided to be shifted from the first pattern string in the first direction by almost a half period and in which the plural first patterns and the plural second patterns are combined and are arranged, wherein the code pattern is printed on a seal affixed to an outer peripheral surface of the toner container to be readable by a photosensor, and the first pattern and the second pattern represented by two colors different in lightness are alternately arranged at a specified period in one string, and the first pattern string in which a ratio of occupation of the first pattern in one period is large, and the second pattern string in which a ratio of occupation of the second pattern in one period is large are combined and arranged.

3. A toner cartridge attachable to a main body of an image forming apparatus or detachable from the main body, comprising:

a toner container that is inserted into a housing unit of the image forming apparatus from a first direction and can be mounted; and a code pattern that is provided on an outer peripheral surface of the toner container and can be optically read, wherein the code pattern includes a first pattern string which is provided along the first direction and in which a first and a second patterns respectively indicating different binary levels are alternately arranged at a specified period, and a second pattern string which is provided to be shifted from the first pattern string in the first direction by almost a half period and in which the plural first patterns and the plural second patterns are combined and are arranged, wherein the toner container includes a guide member on its outer peripheral surface along the first direction, the code pattern includes plural slits formed in the guide member, the first pattern string includes plural slits provided regularly at a specified period along the insertion direction, and the second pattern string includes a combination of plural slits which are arranged to be shifted from the first pattern string in the first direction by almost the half period and are different in width.

4. An image forming apparatus comprising:

a toner cartridge which is inserted into the image forming apparatus from a first direction and can be mounted, and in which a code pattern is provided on an outer peripheral surface along the first direction; read means attached to the image forming apparatus and for reading the code pattern at a time of mounting of the toner cartridge; and a control unit configured to process information of the code pattern read by the read means, wherein the code pattern includes a first pattern string which is provided along the first direction and in which a first and a second patterns respectively indicating different binary levels are alternately arranged at a specified period, and a second pattern string which is provided to be shifted from the first pattern string in the first direction by almost a half period and in which the plural first patterns and the plural second patterns are combined and are arranged, and wherein the toner cartridge includes a guide member on its outer peripheral surface along the insertion direction, the code pattern includes plural slits formed in the guide member, and the read means includes a photosensor, and the photosensor includes a light emitting element to irradiate a light to the slit of the code pattern, and a light receiving element to receive the light having passed through the slit.

* * * * *